US009695984B2

(12) United States Patent
Madsen

(10) Patent No.: US 9,695,984 B2
(45) Date of Patent: Jul. 4, 2017

(54) PLANT FOR REGASIFICATION OF LNG

(75) Inventor: Per Helge S. Madsen, Stathelle (NO)

(73) Assignee: Hamworthy Gas Systems AS, Asker (NO)

( * ) Notice: Subject to any disclaimer, the term of this patent is extended or adjusted under 35 U.S.C. 154(b) by 891 days.

(21) Appl. No.: 13/509,197

(22) PCT Filed: Nov. 12, 2010

(86) PCT No.: PCT/NO2010/000414
§ 371 (c)(1),
(2), (4) Date: May 10, 2012

(87) PCT Pub. No.: WO2011/059344
PCT Pub. Date: May 19, 2011

(65) Prior Publication Data

US 2012/0222430 A1 Sep. 6, 2012

(30) Foreign Application Priority Data

Nov. 13, 2009 (NO) ..... 20093341

(51) Int. Cl.
*F17C 7/04* (2006.01)
*F17C 9/04* (2006.01)
*F17C 9/02* (2006.01)

(52) U.S. Cl.
CPC ..... *F17C 7/04* (2013.01); *F17C 9/02* (2013.01); *F17C 9/04* (2013.01);
(Continued)

(58) Field of Classification Search
CPC ..... F17C 9/02–9/04; F17C 2227/0318; F17C 2227/0393
(Continued)

(56) References Cited

U.S. PATENT DOCUMENTS 3,986,340 A * 10/1976 Bivins, Jr. ..... 62/50.2
4,400,947 A * 8/1983 Ruhemann ..... 60/648
(Continued)

FOREIGN PATENT DOCUMENTS

EP 0048316 3/1982
GB 2 008 239 5/1979
(Continued)

OTHER PUBLICATIONS

Notice of Reasons for Rejection mailed Jul. 30, 2013, directed to JP Application No. 2012-538783; 5 pages.
(Continued)

*Primary Examiner* — Justin Jonaitis
*Assistant Examiner* — Joel Attey
(74) *Attorney, Agent, or Firm* — Morrison & Foerster LLP

(57) ABSTRACT

A plant for regasification of LNG includes a pump boosting LNG pressure, an LNG/coolant heat exchanger producing NG from LNG from the boosting pumps, and a closed coolant loop extending through the LNG/coolant heat exchanger and including a heat exchanger. The coolant from the heat exchanger is passed through the LNG heat exchanger as a gas and leaving in a condensed state to produce NG by thermal exchange. A heating medium is used within the heat exchanger to provide coolant in a gaseous state. An NG/coolant heat exchanger is arranged in connection with the LNG/coolant heat exchanger and is connected to the closed coolant loop. LNG is preheated within the LNG/coolant heat exchanger and NG is trim heated within the NG/coolant heat exchanger using liquid coolant from at least one heat exchanger.

11 Claims, 7 Drawing Sheets

Figure 1:
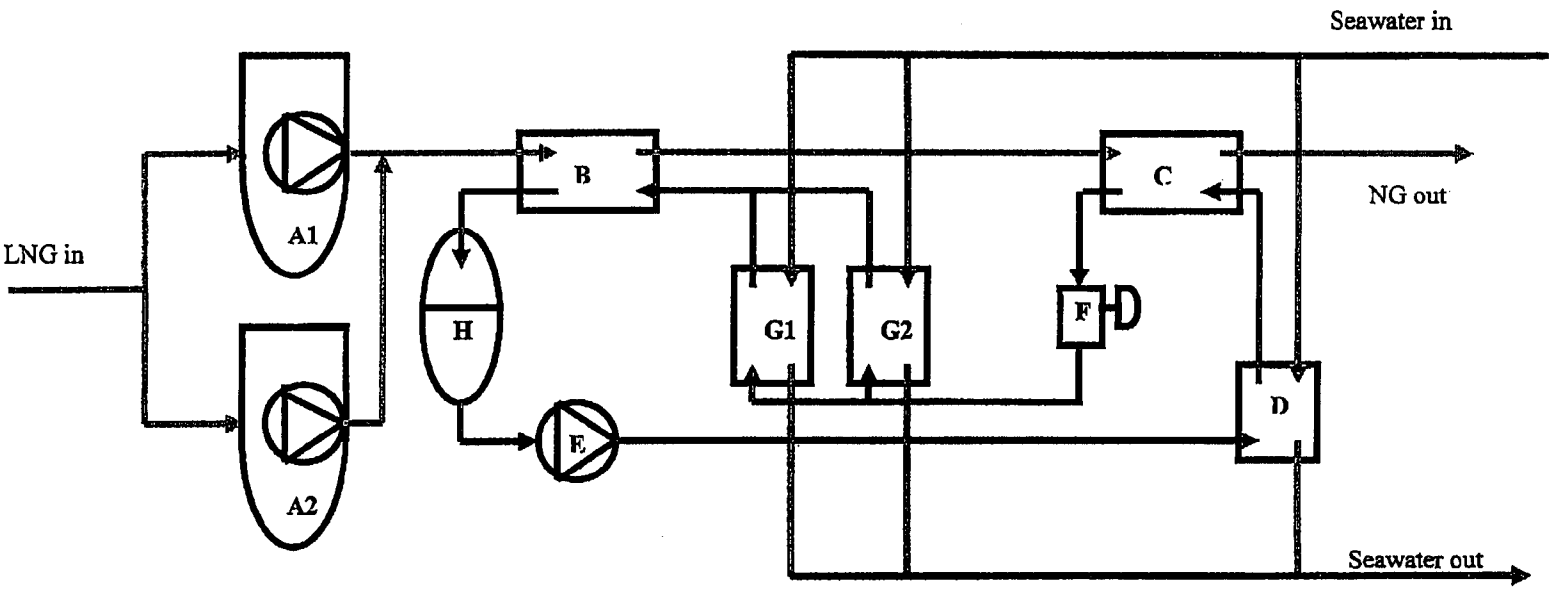

(52) U.S. Cl.
CPC *F17C 2221/033* (2013.01); *F17C 2223/0161* (2013.01); *F17C 2223/033* (2013.01); *F17C 2225/0123* (2013.01); *F17C 2227/0135* (2013.01); *F17C 2227/0178* (2013.01); *F17C 2227/0185* (2013.01); *F17C 2227/0318* (2013.01); *F17C 2227/0323* (2013.01); *F17C 2227/0341* (2013.01); *F17C 2227/0355* (2013.01); *F17C 2227/0393* (2013.01); *F17C 2250/0626* (2013.01); *F17C 2265/05* (2013.01); *F17C 2270/0105* (2013.01)

(58) Field of Classification Search
USPC ..... 62/50.2
See application file for complete search history.

(56) References Cited

U.S. PATENT DOCUMENTS

| | | | | |
|---|---|---|---|---|
| 4,444,015 | A * | 4/1984 | Matsumoto et al. | 60/648 |
| 6,089,022 | A | 7/2000 | Zednik et al. | |
| 6,089,028 | A * | 7/2000 | Bowen et al. | 62/50.2 |
| 6,367,258 | B1 * | 4/2002 | Wen et al. | 60/641.7 |
| 6,367,429 | B2 | 4/2002 | Iwasaki et al. | |
| 6,598,408 | B1 | 7/2003 | Nierenberg | |
| 6,945,049 | B2 | 9/2005 | Madsen | |
| 7,028,481 | B1 * | 4/2006 | Morrow | 60/649 |
| 7,069,743 | B2 * | 7/2006 | Prim | 62/620 |
| 7,293,600 | B2 * | 11/2007 | Nierenberg | 165/41 |
| 7,900,451 | B2 * | 3/2011 | Amir et al. | 60/641.7 |
| 8,156,758 | B2 * | 4/2012 | Denton et al. | 62/620 |
| 2001/0008126 | A1 * | 7/2001 | Iwasaki et al. | 122/31.1 |
| 2004/0065085 | A1 * | 4/2004 | Madsen | 60/641.7 |
| 2006/0156744 | A1 * | 7/2006 | Cusiter et al. | 62/50.2 |
| 2006/0242969 | A1 * | 11/2006 | Minton et al. | 62/50.2 |
| 2007/0125122 | A1 * | 6/2007 | Mak et al. | 62/620 |
| 2007/0214806 | A1 * | 9/2007 | Faka | 62/50.2 |
| 2007/0271932 | A1 * | 11/2007 | Dutt et al. | 62/50.2 |
| 2008/0115508 | A1 * | 5/2008 | Kotzot | F17C 7/04 62/50.2 |
| 2008/0148742 | A1 * | 6/2008 | Nierenberg | 62/50.2 |
| 2008/0302103 | A1 * | 12/2008 | Minkkinen et al. | 60/693 |
| 2009/0199576 | A1 * | 8/2009 | Ciccarelli | 62/50.3 |
| 2009/0277189 | A1 * | 11/2009 | Eie et al. | 62/50.2 |
| 2011/0132003 | A1 * | 6/2011 | Pozivil et al. | 62/45.1 |
| 2012/0317997 | A1 * | 12/2012 | Pozivil et al. | 62/50.2 |

FOREIGN PATENT DOCUMENTS

| | | | | |
|---|---|---|---|---|
| JP | 56-55797 | | 5/1981 | |
| JP | 57-83798 | | 5/1982 | |
| JP | 4-506996 | | 12/1992 | |
| JP | 2008-519221 | | 6/2008 | |
| JP | 2009-530549 | | 8/2009 | |
| WO | WO-91/17406 | | 11/1991 | |
| WO | WO-2006/052896 | | 5/2006 | |
| WO | WO-2007/105042 | | 9/2007 | |
| WO | PCT/IB 2009/006682 | * | 7/2009 | F17C 7/04 |

OTHER PUBLICATIONS

Letter dated Aug. 20, 2013, from SHIGA International Patent Office. "Foreign Associate's Comments on the Japanese Office Action dated Jul. 30, 2013"; 2 pages.
Notice of Office Action mailed Dec. 23, 2013, directed to KR Patent Application No. 10-2012-7015313; 7 pages.
Search Report mailed Feb. 9, 2011, directed to International Patent Application No. PCT/NO2010/000414; 3 pages.
Preliminary Report on Patentability dated Oct. 6, 2011, directed to International Patent Application No. PCT/NO2010/000414; 8 pages.
Search Report dated Oct. 28, 2016, directed to KR Application No. 0488/2012; 4 pages.
Office Action dated Sep. 9, 2016, directed to CA Application No. 2,778,929; 4 pages.
Office Action dated Mar. 10, 2017, directed to CA Application No. 2,778,929; 3 pages.

* cited by examiner

Plant A compsition

LNG In

| | | |
|---|---|---|
| MF Methane | 0.8793 | |
| MF Ethane | 0.0848 | |
| MF Propane | 0.0195 | |
| MF i-Butane | 0.0034 | |
| MF n-Butane | 0.0034 | |
| Comp mole frac(i-pentane+) | 0.0000 | |
| MF N2 | 0.0096 | |
| Mass flow | 2.300e+005 | kg/h |
| Std Gas Flow | 2.991e+005 | STD_m3/h |
| Temperature | -1542 | °C |
| Actual volume flow | 494.3 | m3/h |

| Propane to tank | | |
|---|---|---|
| T | -19.00 | °C |
| P | 253.1 | kPa |
| Vf | 0.0000 | |

| Propane to SW heater | | |
|---|---|---|
| T | -18.43 | °C |
| P | 900.0 | kPa |
| F | 812.0 | m3/h |

| NG Out | | |
|---|---|---|
| T | 2.000 | °C |
| P | 1.105e+004 | kPa |
| Act Vol | 1775 | m3/h |

| Methane from in tank pump | | |
|---|---|---|
| T | -160.0 | °C |
| P | 500.0 | kPa |

| NG from PCHE | | |
|---|---|---|
| T | -20.00 | °C |
| P | 1.120e+004 | kPa |

| Propane gas in | | |
|---|---|---|
| T | -5.405 | °C |
| P | 400.0 | kPa |
| Vf | 0.6225 | |

| PCHE | | |
|---|---|---|
| Q | 1.225e+008 | kJ/h |

| PCHE trim heater | | |
|---|---|---|
| Q | 2.139e+007 | kJ/h |

| Propane in | | |
|---|---|---|
| T | 7.000 | °C |
| P | 800.0 | kPa |

| SW in evap | | |
|---|---|---|
| T | 11.00 | °C |
| P | 250.0 | kPa |
| M | 3.309e+006 | kg/h |

| SW out evap | | |
|---|---|---|
| T | 3.000 | °C |
| P | 100.0 | kPa |
| M | 3.309e+006 | kg/h |

| Propane to evaporator | | |
|---|---|---|
| T | -11.94 | °C |
| P | 500.0 | kPa |
| Vf | 0.0000 | |

| 1 | | |
|---|---|---|
| T | -11.97 | °C |
| P | 650.0 | kPa |
| Vf | 0.0000 | |

| SW in heater | | |
|---|---|---|
| T | 11.00 | °C |
| P | 250.0 | kPa |
| M | 8.129e+005 | kg/h |

| SW out heater | | |
|---|---|---|
| T | 3.000 | °C |
| P | 50 | kPa |
| M | 8.129e+005 | kg/h |

Figure 5b

| Material Streams | | | | | | | | | | | | | | | | |
|---|---|---|---|---|---|---|---|---|---|---|---|---|---|---|---|---|
| | | NG Out | Propane in | propane to tank | propane to SW heater | Methane from in tank pump | NG from PCHE | LNG in | LNG in-2 | 1 | propane gas in | propane to evaporator | SW out evap | SW in evap | SW in heater | SW out heater |
| Vapour fraction | | 1.0000 | 0.0000 | 0.0000 | 0.0000 | 0.0000 | 1.0000 | 0.0000 | 1.0000 | 0.0000 | 0.6225 | 0.0000 | 0.0000 | 0.0000 | 0.0000 | 0.0000 |
| Temperature | °C | 2.000 | 7.000 | -19.00 | -18.43 | -160.0 | -20.00 | -154.2 | 15.00 | -11.97 | -5.405 | -11.94 | 3.000 | 11.00 | 11.00 | 3.000 |
| Pressure | kPa | 1.105e+004 | 800.0 | 253.1 | 900.0 | 500 | 1.120e+004 | 1.140e+004 | 103.3 | 850.0 | 400.0 | 500.0 | 100.0 | 250.0 | 250.0 | 50.00 |
| Molar flow | kgmole/h | 1.265e+004 | 1.020e+004 | 1.020e+004 | 1.020e+004 | 1.265e+004 | 1.265e+004 | 1.265e+004 | 1.108e+004 | 1.020e+004 | 1.020e+004 | 1.020e+004 | 1.837e+005 | 1.837e+005 | 4.512e+004 | 4.512e+004 |
| Mass flow | kg/h | 2.300e+005 | 4.500e+005 | 4.500e+005 | 4.500e+005 | 2.300e+005 | 2.300e+005 | 2.300e+005 | 2.100e+005 | 4.500e+005 | 4.500e+005 | 4.500e+005 | 3.309e+006 | 3.309e+006 | 8.129e+005 | 8.129e+005 |
| Liquid volume flow | m3/h | 721.2 | 888.1 | 888.1 | 888.1 | 721.2 | 721.2 | 721.2 | 645.7 | 888.1 | 888.1 | 888.1 | 3316 | 3316 | 814.5 | 814.5 |
| Heat flow | kJ/h | -1.011e+009 | -1.247e+009 | -1.276e+009 | -1.275e+009 | -1.162e+009 | -1.032e+009 | -1.154e+009 | -8.601e+008 | -1.268e+009 | -1.153e+009 | -1.268e+009 | -5.274e+010 | -5.262e+010 | -1.293e+010 | -1.295e+010 |

Figure 5c

PLANT FOR REGASIFICATION OF LNG

The present invention relates to regasification of liquefied gases, and in particular a plant for regasification of liquefied gas, e.g. liquefied natural gas (LNG), primarily but not exclusively intended for installation on a seagoing vessels.

Natural gas is produced from subterranean reservoirs throughout the world. Such gas in the form of methane, for instance, is a valuable commodity, and various methods and to equipment exist for the extraction, treatment and transportation of the natural gas from the actual reservoir to consumers. The transport is often performed by means of a pipe-line in which gas in the gaseous state from the reservoir is conveyed onshore. However, many reservoirs are located in remote areas or areas with restricted accessibility, involving that utilization of a pipeline is either technically very complicated or economically unprofitable. One very common technique is then to liquefy the natural gas at or near the production site, and transport LNG to the market in specially designed storage tanks, often situated aboard a sea-going vessel.

Liquefying natural gas involves compression and cooling of gas to cryogenic temperatures, e.g. −160° C. Thus, LNG carriers may transport a significant amount of LNG to destinations at which the cargo is offloaded to dedicated tanks onshore, before either being transported by road or rail on LNG carrying vehicles or revaporized and transported by e.g. pipelines.

It is often more favourable to revaporize LNG aboard the seagoing carrier before the gas is off-loaded into onshore pipelines, for instance. U.S. Pat. No. 6,089,022 discloses such a system and method for regasifying LNG aboard a carrier vessel before revaporized gas is transferred to shore. LNG is flowed through one or more vaporizers positioned aboard the vessel. Seawater surrounding the carrier vessel is flowed through a vaporizer to heat and vaporize LNG to natural gas before offloading to onshore facilities.

According to U.S. Pat. No. 6,089,022 the "TRI-EX" Intermediate Fluid-type LNG vaporizer is capable of using seawater as the principal heat exchange medium. Such type of vaporizer is also disclosed by U.S. Pat. No. 6,367,429 in principle comprising a housing with a pre-heat and final heating section. The pre-heat section has a plurality of pipes running therethrough which fluidly connect two manifolds arranged at either end of the pre-heat section. The final heating section has also a plurality of pipes running therethrough which fluidly connect two other manifolds at either end of the final heating section. Seawater surrounding the vessel is pumped into a manifold and flows through the pipes in the final heating section and into the manifold before flowing through the pipes in the pre-heat section and into the manifold, from which the seawater is discharged into the sea. In operation, LNG flows from a booster pump and into a looped circuit positioned within the pre-heat section of the vaporizer, which in turn contains a "permanent" bath of an evaporative coolant, e.g. propane, in the lower portion. Seawater flowing through the pipes "heats" the propane in the bath, causing propane to to evaporate and rise within the precooling section. As propane gas contacts the looped circuit, heat is given to extremely cold LNG flowing through the circuit and recondensed as to fall back into the bath, thereby providing a continuous, circulating "heating" cycle of propane within the pre-heat section.

Although the solution mentioned above seems to give good results under given conditions, their use and applicability are nonetheless restricted by certain limitations and disadvantages. It is for example not possible to control the condensation pressure in the known systems. Furthermore, the evaporative coolant, e.g. propane, is also allowed to evaporate and condense in an unrestrained fashion, thereby involving in a relatively slow heat transfer process and—in order to achieve optimum system efficiencies—large volumes are required. The result is often very large installations presupposing valuable deck space.

To remedy these challenges, U.S. Pat. No. 6,945,049 proposes a method and system for regasification of LNG aboard a floating carrier vessel before gas is offloaded comprising boosting and flowing LNG into an LNG/coolant heat exchanger in which LNG is evaporated, and flowing evaporated natural gas (NG) into a NG/steam heat exchanger, in which NG is heated before being transferred onshore as superheated vapour. LNG in the LNG/coolant heat exchanger is evaporated by thermal exchange against a coolant entering the heat exchanger as a gas and leaving the same in a liquefied state. Moreover, coolant is flowed in a closed circuit and through at least one coolant/seawater heat exchanger in which liquefied coolant is evaporated before entering the LNG/coolant heat exchanger, and the pressure in evaporated coolant is controlled.

In the propane loop presented by U.S. Pat. No. 6,945,049, the temperature difference between seawater entering and leaving the coolant/seawater heat exchanger has to be relatively high as to avoid voluminous dimensions. Typically, the evaporation temperature of coolant is 20-25° C. below inflowing seawater and, thus, the temperature out from the coolant/seawater heat exchanger is 25-30° C. below seawater or even lower (preheating). NG is additionally heated within a NG/steam heat exchanger of shell & tube type. The latter could be replaced by a direct NG/seawater heat exchanger in which s NG is typically heated from −20° C. until some below seawater within a shell & tube type heat exchanger made from titanium. NG and seawater are directed on the tube side and shell side, respectively (trim heating). High pressure on the NG side make the titanium shall & tube heat exchanger very expensive and, to reduce costs, this is constructed like an all welded heat exchanger having straight tubes due to considerably reduced diameter and elimination of the very expensive tube plate compared with a heat exchanger having U-tubes.

Using all welded heat exchangers result in equipment impossible to opened for maintenance, e.g. to clean fouling on the seawater side and plug tubes in case of ruptures. Such a solution having all welded tube heat exchangers is unfavourably as regards maintenance, for instance. Using seawater as one of the media involves that the titanium heat exchangers needed become very costly when these have to be constructed to withstand high pressures as well.

Thus, it is obviously a need for further improvement of the technology presented by U.S. Pat. No. 6,945,049 to reduce costs and to facilitate maintenance, for instance.

According to the present invention, it is proposed a plant for regasification of LNG, comprising:

- at least one pump boosting LNG pressure;
- a LNG/coolant heat exchanger producing NG from LNG being flowed from the boosting pumps;
- a closed coolant loop extending through the LNG/coolant heat exchanger and including at least one heat exchangers, a coolant from the respective heat exchanger being passed through the LNG heat exchanger as a gas and leaving in a condensed state as to produce NG by thermal exchange; and
- a heating medium being used within the respective heat exchanger as to provide coolant in a gaseous state, wherein a NG/coolant heat exchanger is arranged in connection with the LNG/coolant heat exchanger and is connected to the closed coolant loop, whereby LNG is preheated within the LNG/coolant heat exchanger and NG is trim heated within the NG/coolant heat exchanger using liquid coolant from at least one heat exchanger.

To maintain the pressure through the NG/coolant heat exchanger and its heat exchanger above the boiling pressure at seawater temperature, a control valve is arranged in the closed coolant loop.

The LNG/coolant and NG/coolant heat exchangers can favourably be constructed as compact printed circuit heat exchangers. The two heat exchanger may be combined to a single heat exchanger having one LNG/NG path and at least one separate path for coolant in preheating and trim heating portions, respectively.

Further, the heat exchangers included in the closed coolant loop are preferentially semi welded plate heat exchangers.

To boost LNG being flowed into the LNG/coolant heat exchanger, it is favourably used at least one multistage centrifugal pump, whereas coolant is circulated by means of a centrifugal pump, for instance.

Favourably, the coolant is propane, and the heating medium is seawater.

An external heater can be arranged to preheat water fed into the heat exchanger in connection with the NG/coolant heat exchanger, alternatively to preheat seawater fed into all heat exchangers in the closed coolant loop.

Figure 4:
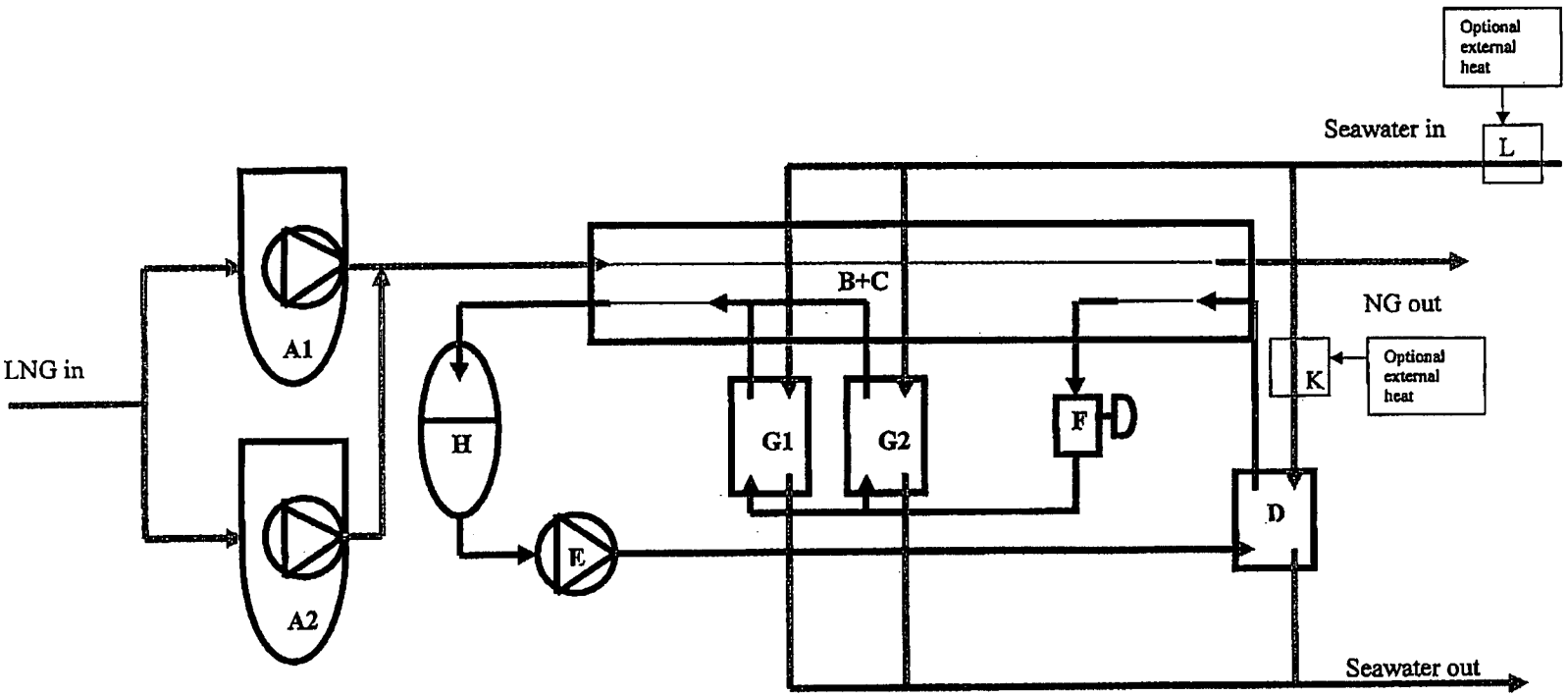
Figure 5A:
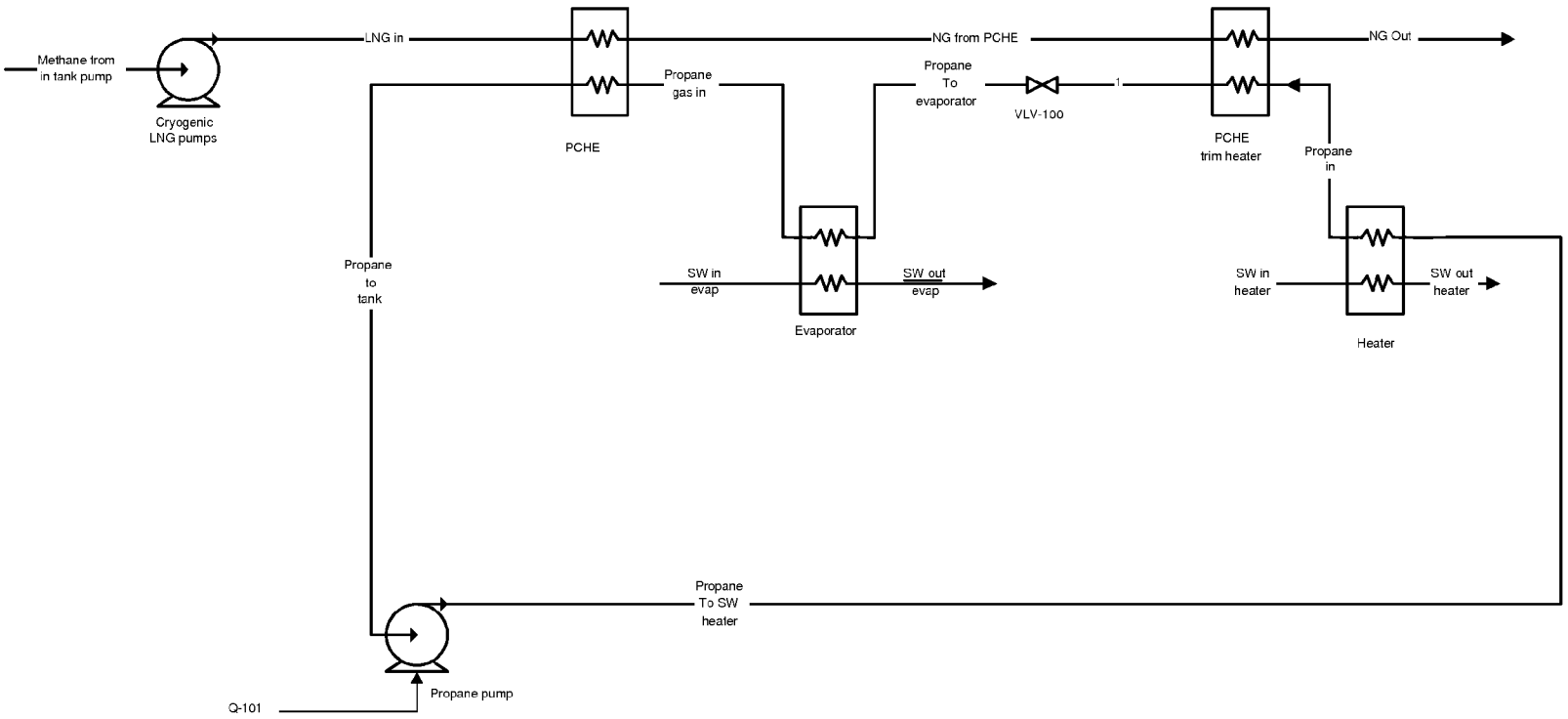

Embodiments according to the present invention are now to be described in further detail, in order to exemplify its principles, operation and advantages. The description refers to the following drawings, not necessarily to scale, where like parts have been given like reference numerals:

FIGS. 1 to 4 are simplified schematic flow diagrams of the regasification plant according to various embodiments of the present invention; and FIG. 5 is a simplified flow diagram of one embodiment of the present invention.

The present regasification plant comprises basically two circuits: a coolant circuit and a NG circuit. Propane is often preferred as a coolant due to thermodynamic properties and freezing point but any suitable fluid having an evaporation temperature of about 0° C. in the pressure ranges 200-2500 kPa may be suitable.

As illustrated in FIG. 1, for instance, LNG is fed from onboard tanks (not shown) and into at least one high pressure pump A1, A2 which boosts LNG pressure, and from which boosted LNG is flowed into a LNG/coolant heat exchanger B. Each pump is a multistage centrifugal pump, for instance, being submerged pot mounted. LNG temperature upon entering the LNG/coolant heat exchanger is typically −160° C., and it is preheated to −20° C. and higher before exit. Preheating is effected by means of phase transition for liquefied coolant similar to U.S. Pat. No. 6,945,049. The LNG/coolant heat exchanger may be a compact printed circuit heat exchanger PCHE made from stainless steel or any suitable material.

NG leaves the LNG/coolant heat exchanger B in an evaporated state and enters a NG/coolant heat exchanger C in which NG is trim heated before conveyed onshore as superheated vapour. The trim heating is performed by temperature glide for liquefied coolant. The vapour temperature is typically 5-10° C. below seawater inlet temperature.

The coolant circuit is fed from a coolant supply H, e.g. a tank, and driven by a pump E into a semi welded plate heat exchanger D. Although illustrated as being mounted outside the coolant supply, the pump, e.g. a centrifugal pump, may also be of the submerged pot mounted type like the pumps A1, A2 mentioned above. Coolant is heated by means of seawater passing through the plate heat exchanger opposite of coolant, typically up to 2-5° C. below ingoing seawater temperature. Then, heated coolant is fed into the NG/coolant heat exchanger C to provide for trim heating of NG.

Cooled coolant leaving the NG/coolant heat exchanger C is pressure relieved by means of a control valve F before it enters at least one semi welded plate heat exchanger G1, G2. The control valve may be replaced by any suitable means, e.g. a fixed restriction. An objective of the control valve is to maintain pressure from the pump E through the two heat exchangers D, C above boiling pressure of coolant at seawater temperature. Within each plate heat exchanger G1, G2 coolant is evaporated using seawater, each being passed on opposite sides through the heat exchangers.

Figure 2:
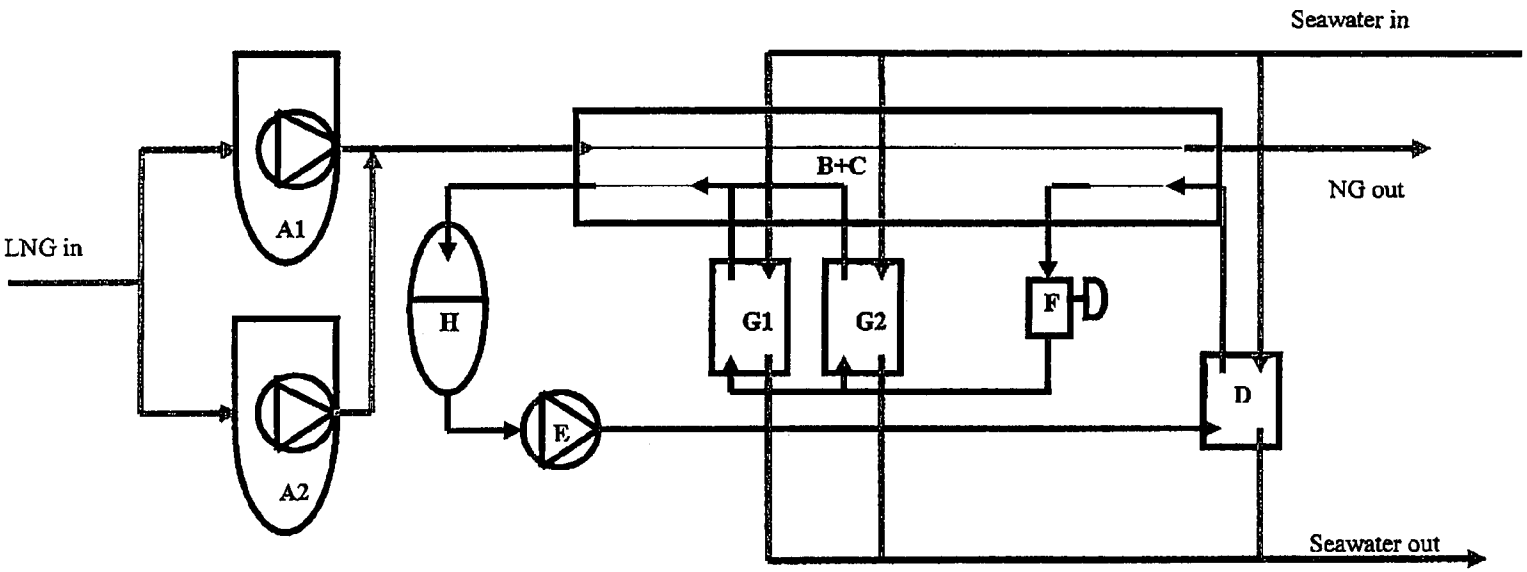
Figure 3:
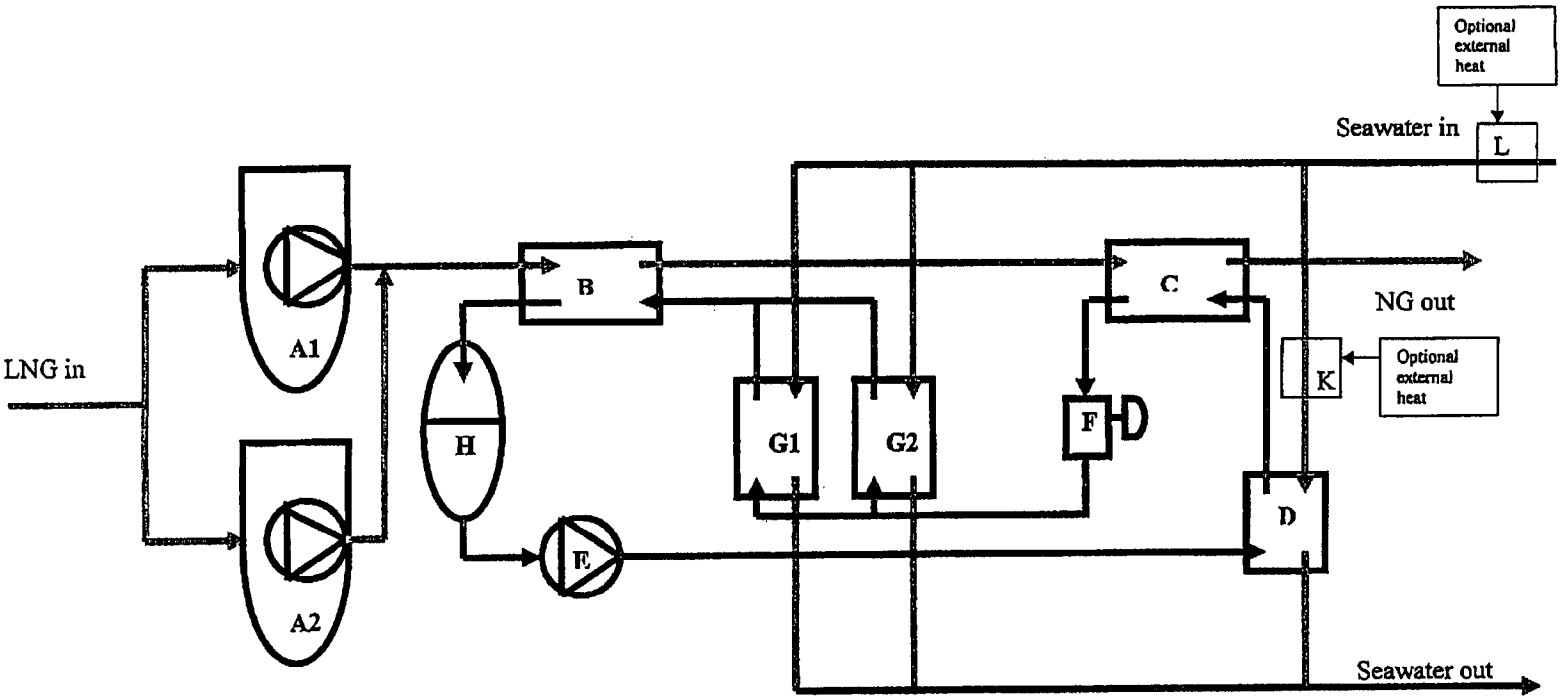

Then, evaporated coolant is passed on to the LNG/coolant heat exchanger B to be condensed while LNG is evaporated on each side within the heat exchanger when preheating LNG. Condensed coolant from the heat exchanger is at last returned into the tank H. Many optional variations are possible, and these are illustrated in a not-exhaustive manner in the drawings. As shown in FIGS. 2 and 4, the preheating and trim heating heat exchangers B, C may be combined to one common heat exchanger. Such common heat exchanger is having one LNG/NG path and at least one separate path for coolant in preheating and trim heating portions, respectively. Seawater being passed into the heat exchanger D may be preheated using an external heater K of appropriate type, see FIGS. 3 and 4. The same could also be done for seawater into skid being preheated using an external heater of appropriate type, see FIGS. 3 and 4. Any suitable coolant than seawater is applicable. Although, many are presented in the drawings as being a single heat exchanger, it is understood that each may be supplemented with additional heat exchanger dependent on capacity and available equipment.

The regasification plant may be installed on a Shuttle Regasification Vessel (SRV) or Floating Storage Regasification Units (FSRU). The regasification plant and its heat exchangers are specially designed for marine installations and for cryogenic working conditions. The plant is based upon proven equipment with extensive references. Compared with the prior art, semi-welded plate heat exchangers are used between the propane and seawater and at least one smaller propane circulating pump may be used.

Without considered mandatory, heat exchangers suitable for the present plant are designed for handling LNG with the following typical composition:

| Composition (Mole %) | Standard liquefied |
|---|---|
| Nitrogen | 0.34% |
| Methane (C1) | 89.50% |
| Ethane (C2) | 6.33% |
| Propane (C3) | 2.49% |
| Butane (C4) | 1.26% |
| Pentane (C5) | 0.08% |
| Hexane (C6) | 0.0% |

Moreover, basic data input data may be:

LNG-Flow: 50-300 tons/hour each skid

LNG inlet temperature: −160° C.

Gas outlet temperature: typically 5-10° C. below seawater temperature

LNG inlet pressure: 4000-20000 kPa

LNG outlet pressure: 200-600 kPa below inlet pressure

Inlet seawater temperature: 5-35° C.

According to FIG. 5 showing a simplified flow diagram of one embodiment of the present invention, LNG at a pressure of 500 kPa and temperature of −160° C. enters the LNG/Propane PCHE heat exchanger. It leaves with a temperature of −20° C. having a pressure of 1,120e+004 kPa and enters the NG/coolant heat exchanger from which superheated vapour leaves with a temperature of 2° C. and a pressure of 1,105e+004 kPa.

In the LNG/coolant PCHE and NG/coolant PCHE heat are exchanged against propane circulating in a closed loop. Propane enters the LNG/coolant PCHE at approximately −5.4° C. and 400 kPa as gas in which the propane is condensed and leaves the PCHE as liquefied at −19° C. and approximately 253.0 kPa. In the NG/coolant PCHE propane enters at 7° C. and 800 kPa as gas and leaves after condensation as liquefied at approximately −11.9° C. and 650 kPa. Propane in the closed loop is first pumped by the pump E and heated against seawater in the plate heat exchanger D in which seawater enters at a temperature of 11° C. and having a pressure of 250 kPa and leaves at 3° C. and 100 kPa. Propane enters at a temperature of approximately −18.4° C. and 900 kPa and leaves for entering the NG/coolant PCHE in the condition specified above. Seawater enters the plate heat exchangers G1, G2 at a temperature of 11° C. and 250 kPa before exiting at 3° C. and 100 kPa. Propane enters at approximately −11.9° C. and 500 kPa and leaves for entering the LNG/coolant PCHE in the condition specified above The discussion above as regards the present invention are to be construed merely illustrative for principles according to the invention, the true spirit and scope of present invention being defined by the patent claims. Although LNG and NG is especially mentioned when discussion the present invention and also for sake of simplicity in the patent claims, this fact is actually not excluding that any appropriate type of liquefied gases such as ethane, propane, $N_2$, $CO_2$ is applicable. As an alternative, it is understood that the present plant also may be installed onshore.

The invention claimed is:

1. A plant for regasification of liquefied natural gas (LNG), comprising:

at least one pump boosting LNG pressure;

an LNG/coolant heat exchanger producing natural gas (NG) from LNG being flowed from the at least one boosting pump;

a closed coolant loop extending through the LNG/coolant heat exchanger and including at least one first heat exchanger, a coolant from the at least one first heat exchanger being passed through the LNG/coolant heat exchanger as a gas and leaving in a condensed state so as to produce NG by thermal exchange;

a heating medium being used within the at least one first heat exchanger configured to provide coolant in a gaseous state, and a second heat exchanger configured to provide heated liquid coolant and being part of the closed coolant loop, wherein an NG/coolant heat exchanger is arranged in connection with the LNG/coolant heat exchanger and is connected to the closed coolant loop, whereby LNG is preheated within the LNG/coolant heat exchanger and NG is trim heated within the NG/coolant heat exchanger using liquid coolant from the second heat exchanger; and a coolant supply that supplies the coolant to the closed coolant loop, wherein the first heat exchanger and the second heat exchanger are connected in series in the closed coolant loop, and the NG/coolant heat exchanger is connected between the first heat exchanger and the second heat exchanger in series in the closed coolant loop so that all coolant from the coolant supply is supplied to the second heat exchanger first, then to the NG/coolant heat exchanger and finally to the first heat exchanger.

2. A plant according to claim 1, wherein the closed loop includes a pressure controlling mechanism by which the pressure through the second heat exchanger and NG/coolant heat exchanger is maintained above the boiling pressure by seawater at a temperature range of 5-35° C.

3. A plant according to claim 2, wherein the pressure controlling mechanism comprises a pump and a valve, the valve controlling the pressure in coolant from the pump through the heat exchanger and NG/coolant heat exchanger above the boiling pressure.

4. A plant according to claim 1, wherein the LNG/coolant heat exchanger and NG/coolant heat exchanger are printed circuit heat exchangers.

5. A plant according to claim 1, wherein the heat exchangers included in the closed coolant loop are semi welded plate heat exchangers.

6. A plant according to claim 1, wherein the at least one booting pump is multistage centrifugal pumps.

7. A plant according to claim 3, wherein the coolant pump is a centrifugal pump.

8. A plant according to claim 1, wherein the coolant is propane.

9. A plant according to claim 1, wherein the heating medium is seawater.

10. A plant according to claim 9, wherein an external heater is arranged to preheat seawater fed into the heat exchanger in connection with the NG/coolant heat exchanger.

11. A plant according to claim 9, wherein an external heater is arranged to preheat seawater fed into all of the heat exchangers.

* * * * *